US005961064A

United States Patent [19]

Dueck

[11] Patent Number: 5,961,064

[45] Date of Patent: Oct. 5, 1999

[54] APPARATUS FOR LONGITUDINALLY SLITTING SHEET MATERIAL

[76] Inventor: Raymond Dueck, Box 700, Arborg, Manitoba, Canada, ROC OAO

[21] Appl. No.: 09/164,266

[22] Filed: Oct. 1, 1998

[51] Int. Cl.[6] ..... B65H 35/02

[52] U.S. Cl. ..... 242/525.5; 242/525.7; 242/538.2; 83/504; 83/649

[58] Field of Search ..... 242/525.7, 525.6, 242/525.5, 538.2; 83/499, 498, 504, 505, 508.3, 507, 509

[56] References Cited

U.S. PATENT DOCUMENTS

| | | | |
|---|---|---|---|
| 1,127,448 | 2/1915 | Jullien | 242/525.5 |
| 1,148,146 | 7/1915 | Cameron et al. | 242/525.6 X |
| 3,682,031 | 8/1972 | Degelleke et al. | 242/525.5 X |
| 3,685,379 | 8/1972 | Frye et al. | 83/499 X |
| 3,803,959 | 4/1974 | Rung | 242/525.5 X |
| 3,944,150 | 3/1976 | Jennerjahn | 242/525.7 |
| 4,077,291 | 3/1978 | Obenshain | 83/499 |
| 4,092,886 | 6/1978 | Nowisch | 242/525.7 X |
| 4,691,749 | 9/1987 | Reuter | 83/499 X |
| 4,809,921 | 3/1989 | Dueck et al. | 242/538.2 X |
| 5,083,489 | 1/1992 | Tidland et al. | 83/504 X |

FOREIGN PATENT DOCUMENTS

| | | | |
|---|---|---|---|
| 491087 | 2/1930 | Germany | 242/525.6 |
| 1374001 | 11/1974 | United Kingdom | 83/498 |

*Primary Examiner*—Donald P. Walsh
*Assistant Examiner*—Minh-Chau Pham
*Attorney, Agent, or Firm*—Adrian D. Battison; Murray E. Thrift

[57] ABSTRACT

The apparatus for longitudinally slitting sheet material comprises a supply assembly for supplying for unrolling a roll of the sheet material, a table surface for receiving the sheet, a re-rolling cradle for receiving a cut portion of the sheet and driven to roll the cut portion into a roll and a slitting assembly for slitting the sheet in a longitudinal direction at least at one position across its width. The slitting assembly comprising an elongate support housing extending across the table transverse to the longitudinal direction of the sheet, at least one slitting knife member mounted on the housing for slitting the sheet, the knife member being movable along the housing for adjustment of the position of the knife member across the sheet so as to vary a width of the portion to be cut. The knife member includes a blade support carried on the housing for sliding movement and an elongate drive shaft extending across the table which is driven at one end. The blade support includes a driven sprocket for receiving drive from shaft and a driven sprocket attach to the disk blade. The drive sprocket is slidable along the shaft with movement of the blade support along the housing and the drive sprocket and the drive shaft are shape in cross-section such that rotation of the drive shaft causes rotation of the drive sprocket for driving the disk blade.

9 Claims, 6 Drawing Sheets

APPARATUS FOR LONGITUDINALLY SLITTING SHEET MATERIAL

FIELD OF THE INVENTION

The present invention relates to apparatus for receiving a rolled sheet material, unrolling a portion of the material, slitting the material longitudinally to form a strip and rerolling the slit strip.

BACKGROUND OF THE INVENTION

Presently strips of material such as belts and the like, carpet and other similar floor covering materials are being used. These strips of material vary in width but are usually quite narrow being about 2 to 4 inches in width. Cutting material this narrow is usually difficult and slow using currently available cutting machines which are designed to cut lengths of material by cutting laterally across an unrolled portion of a roll of material. Cutting machines currently available, in relation to U.S. application No. 08/963,243 (Dueck), are not for heavy usage of large rolls of material, creating a need for a heavy duty device.

SUMMARY OF THE INVENTION

According to the present invention there is provided an apparatus for longitudinally slitting sheet material comprising:

a supply assembly for supplying for unrolling a roll of the sheet material;

a table surface for receiving the sheet from the unrolling cradle such that the sheet passes longitudinally across the table when fed from the unrolling cradle;

a re-rolling cradle for receiving a cut portion of the sheet and driven to roll the cut portion into a roll;

and a slitting assembly for slitting the sheet in a longitudinal direction at least at one position across its width, the slitting assembly comprising:

an elongate support housing extending across the table transverse to the longitudinal direction of the sheet;

at least one slitting knife member mounted on the housing for slitting the sheet, the knife member being movable along the housing for adjustment of the position of the knife member across the sheet so as to vary a width of the portion to be cut;

a counter action member for co-operating with the slitting knife member in a cutting action, the counter action member extending across at least a portion of the table for co-operation with the knife member at a plurality of different positions thereof;

the knife member including a rotating disk blade mounted in a plane longitudinal of the sheet and rotatable about an axis parallel to the sheet and transverse to the sheet;

the knife member including a blade support carried on the housing for sliding movement along the housing, the blade support including a locking member for locking the blade support and the disk blade at a selected position along the housing;

the housing including an elongate drive shaft extending across the table which is driven at one end;

the blade support including a drive sprocket for receiving drive from the shaft, a driven sprocket attached to the disk blade and a continuous drive member connected between the drive sprocket and the driven sprocket;

the drive shaft and the drive sprocket being shaped and arranged such that the drive sprocket is slidable along the shaft with movement of the blade support along the housing;

and the drive sprocket and the drive shaft being shaped in cross-section such that rotation of the drive shaft causes rotation of the drive sprocket for driving the disk blade.

Preferably the locking member on the knife member co-operates with a front end of the elongate support housing for movement across the table, wherein the locking member has at least one handle that can be adjusted inwardly to engage the front end and outwardly to disengage the front end, wherein the locking member has at least one wheel arrangement for engaging a rear end of the housing and wherein the rear end has a wheel guide for supporting the wheel arrangement when the knife is moved along the table.

Preferably the continuous drive member is a chain.

Preferably an engage member is arranged to contact the blade to slit the sheet.

a rubber roller extending across the table transverse to the longitudinal direction of the sheet is arranged to engage the blade for slitting the sheet material.

a comb arrangement having a plurality of slots extending across the table transverse to the longitudinal direction of the sheet is arranged such that the blade engages the sheet material at the slots on the comb arrangement and wherein the comb arrangement is horizontally adjustable for exact slitting of the sheet material by the blade.

BRIEF DESCRIPTION OF THE DRAWINGS

In the accompanying drawings, which illustrate an exemplary embodiment of the present invention.

DETAILED DESCRIPTION

Figure 1:
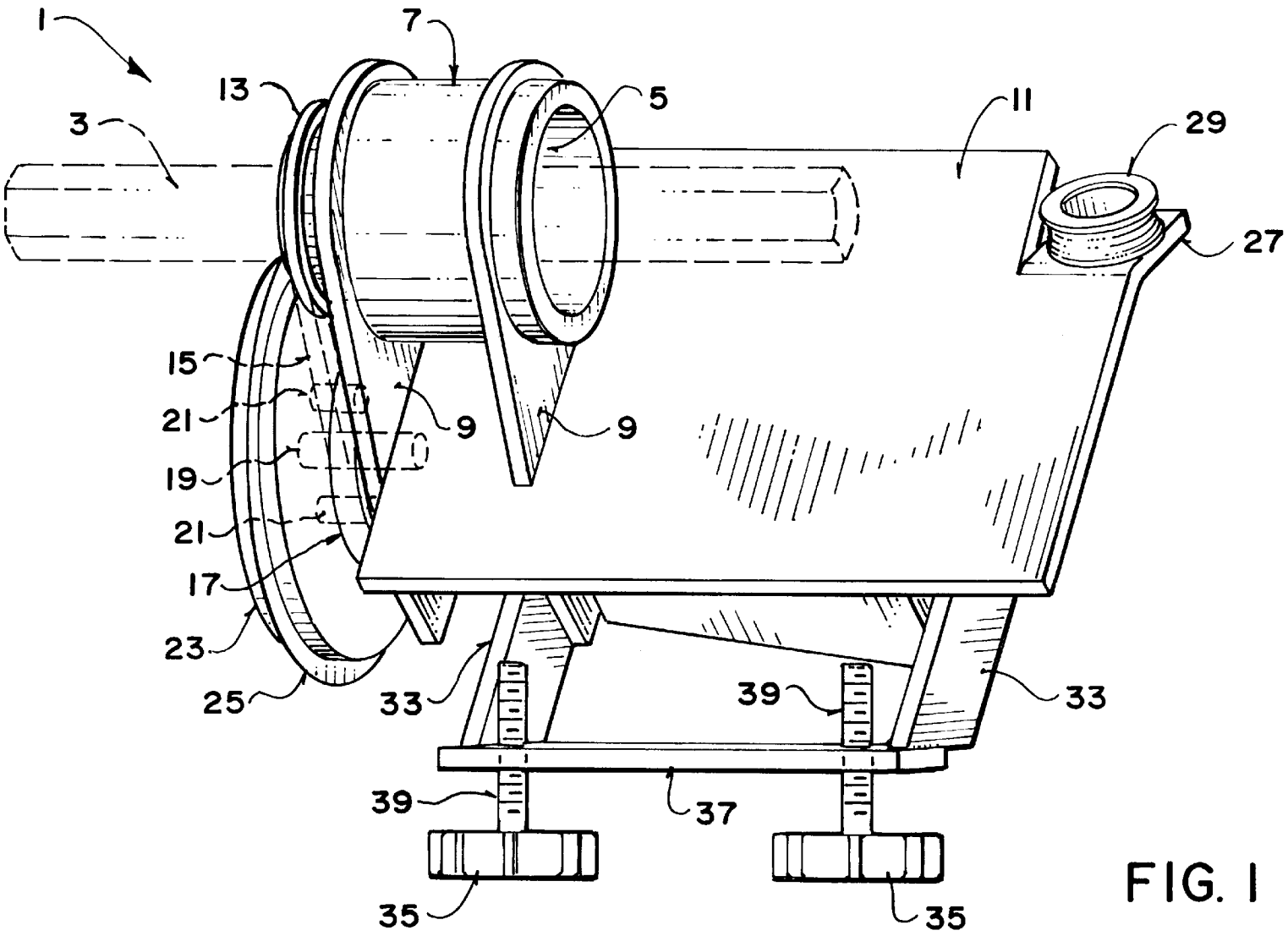
FIG. 1 is an isometric view of the slitting apparatus.
Figure 2:
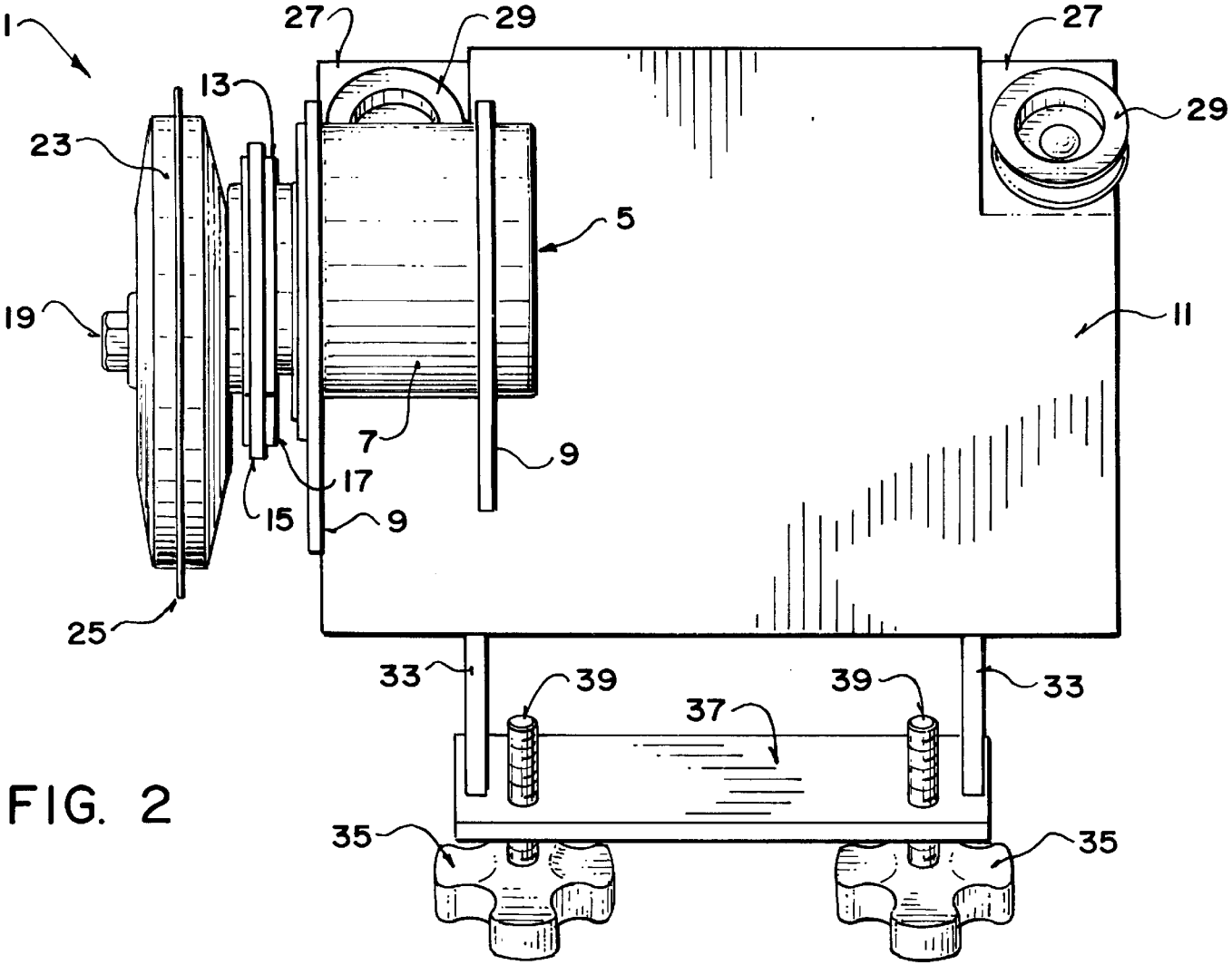
FIG. 2 is a top view of the slitting apparatus.

A slitting apparatus 1 for longitudinally slitting sheet material 2 is mounted on an elongate drive shaft 3 having a horizontal axis which is driven at one end and is positioned along a table 4 transverse to the sheet 2. The drive shaft 3 being hexagon in cross section such that rotation of the drive shaft causes rotation of a drive shaft receive 5.

The drive shaft receive 5 is arranged to be slidable along the shaft and is hexagon in cross section such that the drive shaft receive is rotated by the shaft. The drive shaft receive extends through a sprocket housing 7. The sprocket housing 7 is cylindrical in shape and is on the axis wherein the shaft passes through. The sprocket housing 7 has a pair of parallel downwardly extending mount arms 9 at respective ends of the housing 7 which are attached to a base 11, as described later.

A drive sprocket 13 on a respective side of the housing 7 is arranged to be driven about the axis by the shaft. The sprocket is circular in shape and is arranged to be slidable along the shaft. A belt or chain 15 is mounted on the outer most end of the sprocket and extends downwardly at a right angle to the axis connecting to a chain receive sprocket 17.

The chain receive sprocket is mounted on the mount arms 9 by an axle 19 having a axis parallel to the shafts axis in which the chain receive rotates. A plurality of mount members 21 at respective sides of the axle attach to a disk 23 on the axle arranged to be rotated about the axles axis by the chain receive sprocket being driven by the drive sprocket.

The disk 23 has a cutting blade 25 around the outermost edge of the disk for engaging and cutting the sheet material.

The base 11 is generally square in shape arranged to support the slitting apparatus 1. An angled portion 27 at each back corner is angled downwardly and has a wheel 29 arranged to engage a wheel guide 31 on the support housing, later described. The wheel guide extends horizontally across the table parallel to the shaft such that the slitting apparatus can be slidably adjustable along the table. A pair of adjustment mount arms 33 extend forwardly from respective sides of the base having a handle 35 at each of the front ends. The front end 37 of the adjustment mount arms 33 is angled upwardly such that a thread portion 39 of the handles is at an upward and rearward incline for engaging the table.

The base is mounted on a elongate support housing 55 extending across the table transverse to the longitudinal direction of the sheet. The support housing is arranged to support the base such that the slitting apparatus can be slidably adjustable along the table. The support housing has a front end 57 arranged for engaging an adjustment arrangement 59.

In adjustment of the adjustment arrangement 59 the handles 35 are loosened from the support housing 55 such that the threaded portion disengages the front end 57 so that the slitting apparatus can be slid along the shaft supported by the wheels on the wheel guide.

In operation, a supply assembly 41 is arranged to unroll the sheet material 2 onto the table surface 4A from an unrolling cradle 43. The unrolling cradle passes the sheet longitudinally across the table to a re-rolling cradle 44 for receiving a cut portion 45 of the sheet.

Figure 3:
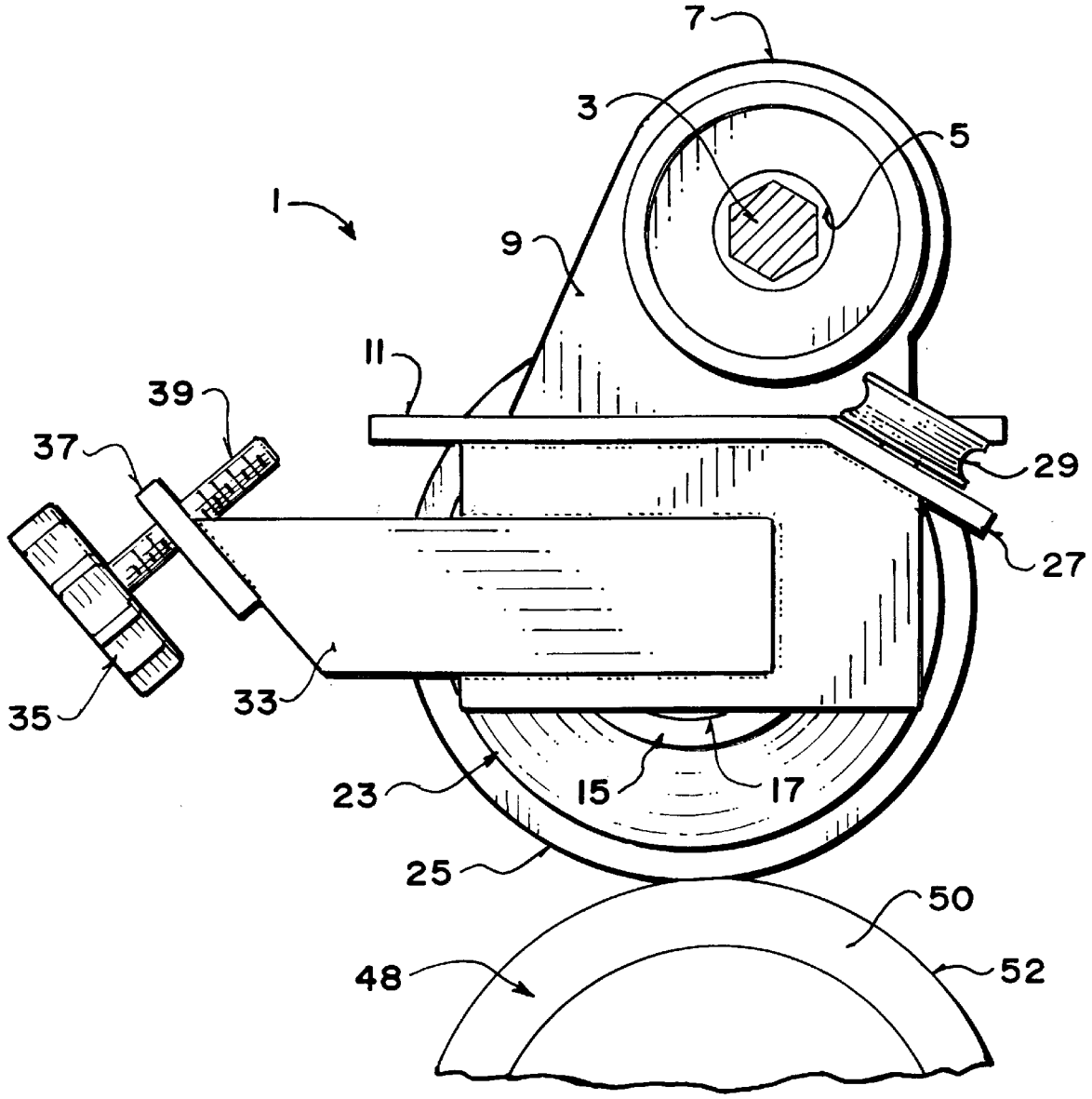
FIG. 3 is a side elevational view of the slitting apparatus.
Figure 4:
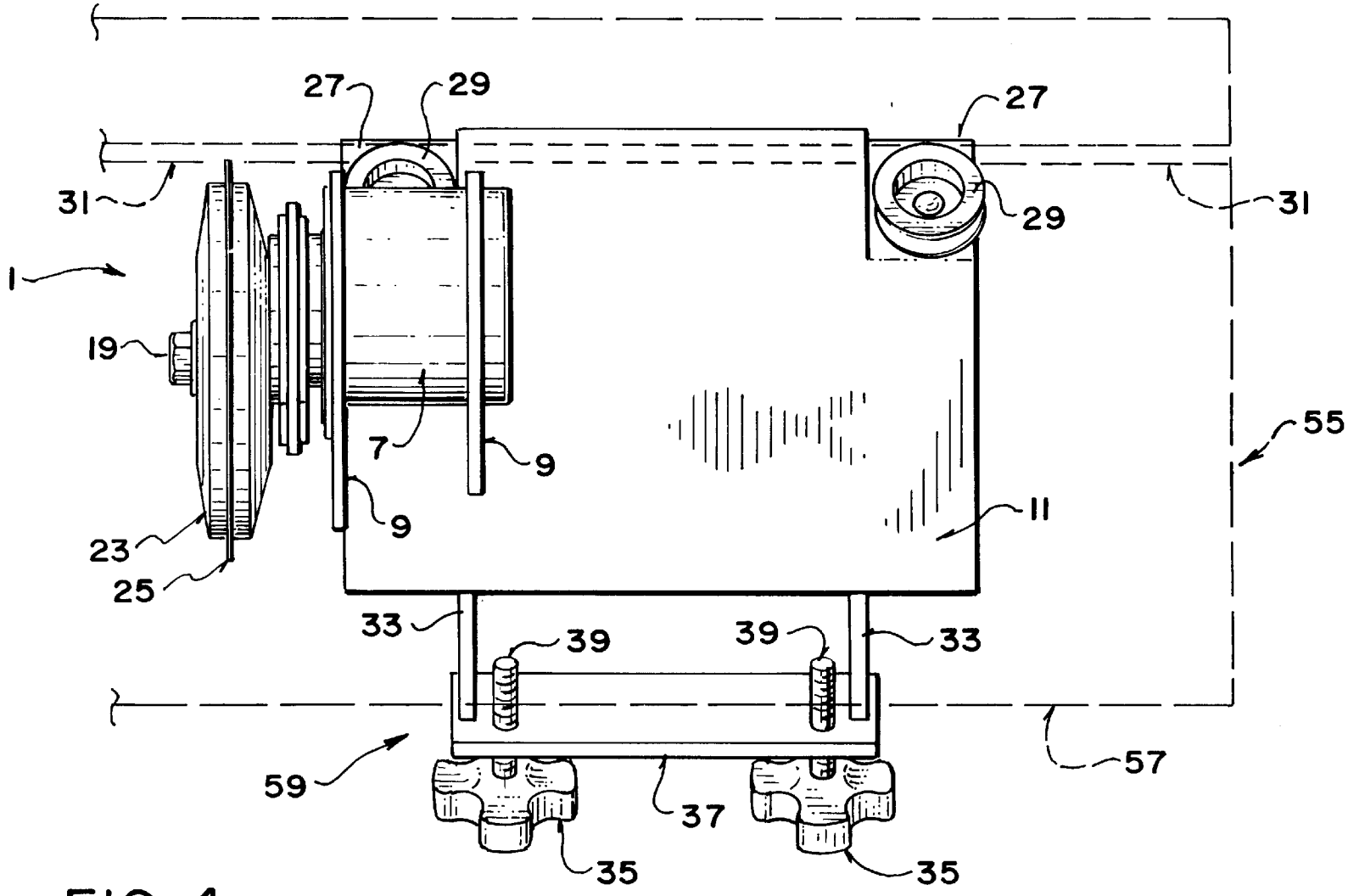
FIG. 4 is a top view of the slitting apparatus.
Figure 5:
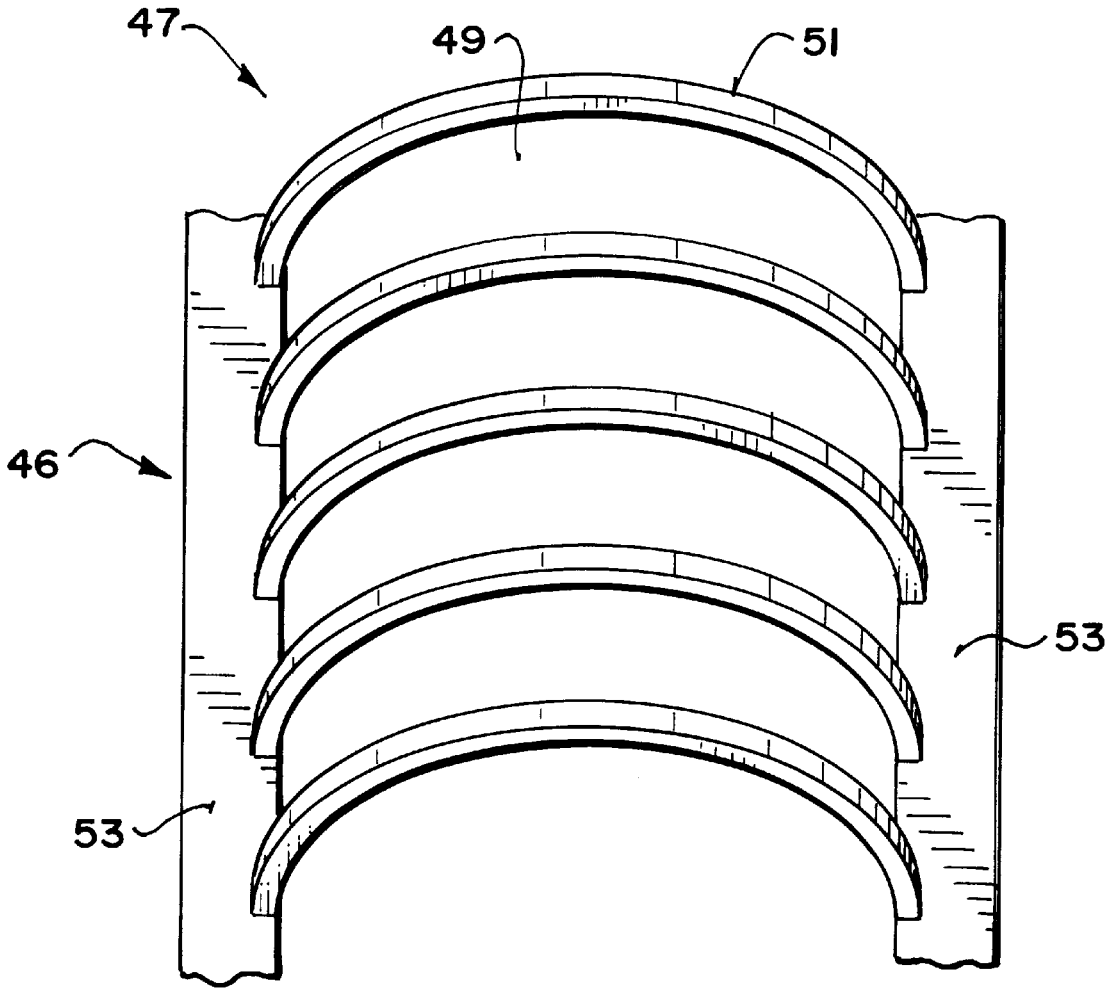
FIG. 5 is an isometric view of the counter action member.
Figure 6:
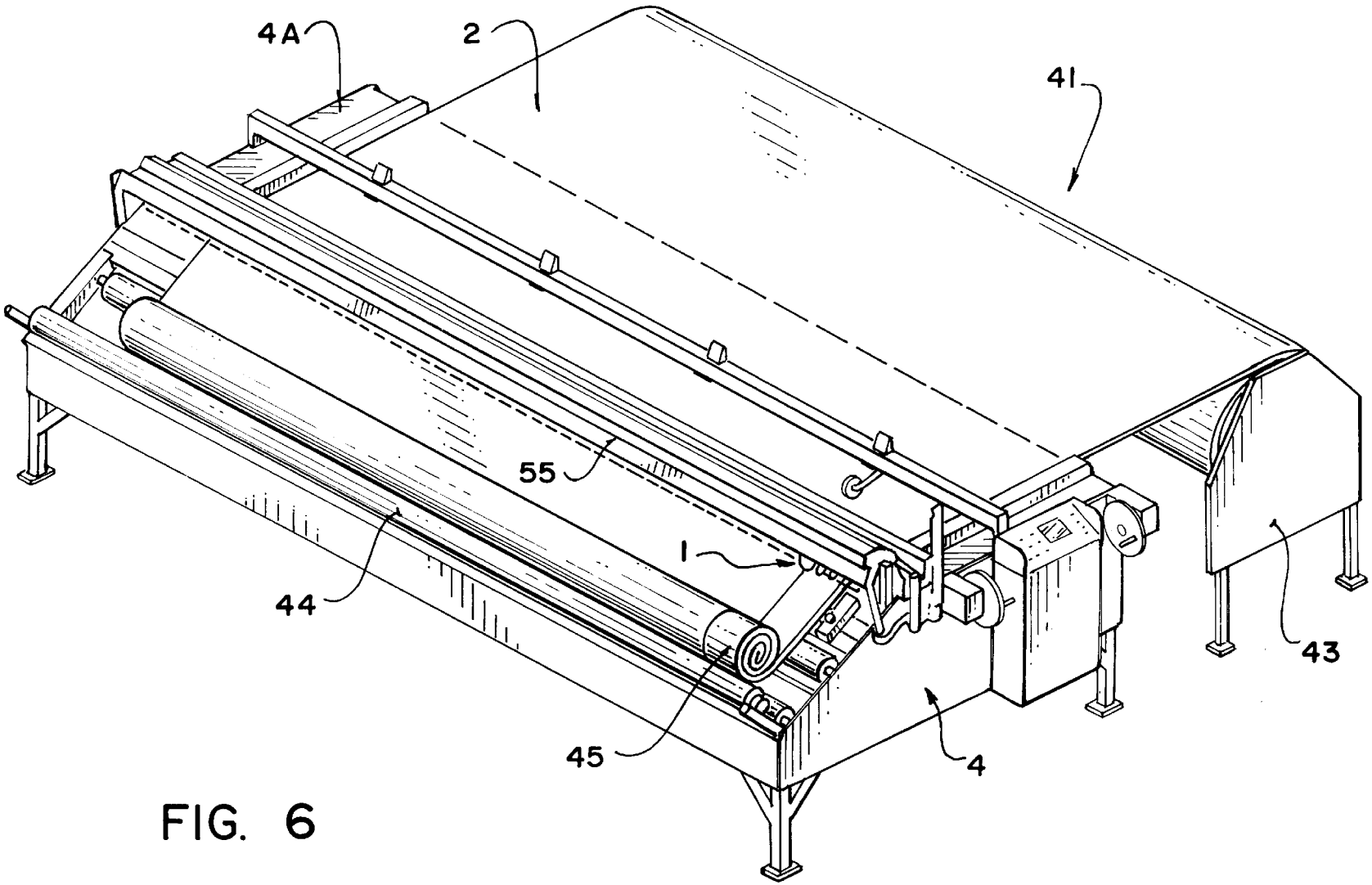
FIG. 6 is an isometric view of the slitting apparatus in use with the table and sheet material.

A counter action member 47 for co-operating with the cutting blade 25 in a cutting action. The counter action member extends across the table parallel to the shaft pushes the sheet upwardly creating an opposing force so that the blade slits the sheet. The counter action member 47 can be a roller 48, as best shown in FIG. 3, or a slotted comb member 46, as best shown in FIG. 5, having a plurality of slots 49 having a upward curve 51 mounted on side plates 53 parallel to the shaft arranged such that the blade engages the sheet between two of the respective slots. The roller 48 extends across the table parallel to the shaft, having slightly resilient material 50 on the outer edge 52 such that the knife engages the roller for slitting the sheet and to discourage the sheet from folding while being rolled therethrough.

While one embodiment of the present invention has been described in the foregoing, it is to be understood that other embodiments are possible within the scope of the invention. The invention is to be considered limited solely by the scope of the appended claims.

I claim:

1. An apparatus for longitudinally slitting sheet material comprising:

a supply assembly for supplying for unrolling a roll of the sheet material;

a table surface for receiving the sheet from the unrolling cradle such that the sheet passes longitudinally across the table when fed from the unrolling cradle;

a re-rolling cradle for receiving a cut portion of the sheet and driven to roll the cut portion into a roll;

and a slitting assembly for slitting the sheet in a longitudinal direction at least at one position across its width, the slitting assembly comprising:

an elongate support housing extending across the table transverse to the longitudinal direction of the sheet;

at least one slitting knife member mounted on the housing for slitting the sheet, the knife member being movable along the housing for adjustment of the position of the knife member across the sheet so as to vary a width of the portion to be cut;

a counter action member for cooperating with the slitting knife member in a cutting action, the counter action member extending across at least a portion of the table for co-operation with the knife member at a plurality of different positions thereof;

the knife member including a rotating disk blade mounted in a plane longitudinal of the sheet and rotatable about an axis parallel to the sheet and transverse to the sheet;

the knife member including a blade support carried on the housing for sliding movement along the housing, the blade support including a locking member for locking the blade support and the disk blade at a selected position along the housing;

the housing including an elongate drive shaft extending across the table which is driven at one end;

the blade support including a drive sprocket for receiving drive from the shaft, a driven sprocket attached to the disk blade and a continuous drive member connected between the drive sprocket and the driven sprocket;

the drive shaft and the drive sprocket being shaped and arranged such that the drive sprocket is slidable along the shaft with movement of the blade support along the housing;

and the drive sprocket and the drive shaft being shaped in crosssection such that rotation of the drive shaft causes rotation of the drive sprocket for driving the disk blade.

2. The apparatus according to claim 1 wherein the locking member on the knife member co-operates with a front end of the elongate support housing for movement across the table.

3. The apparatus according to claim 2 wherein the locking member has at least one handle that can be adjusted inwardly to engage the front end and outwardly to disengage the front end.

4. The apparatus according to claim 2 wherein the locking member has at least one wheel arrangement for engaging a rear end of the housing.

5. The apparatus according to claim 4 wherein the rear end has a wheel guide for supporting the wheel arrangement when the knife is moved along the table.

6. The apparatus according to claim 1 wherein the continuous drive member is a chain.

7. The apparatus according to claim 1 wherein an engage member is arranged to contact the blade to slit the sheet.

8. The apparatus according to claim 7 wherein the engage member is a rubber roller extending across the table transverse to the longitudinal direction of the sheet is arranged to engage the blade for slitting the sheet material.

9. The apparatus according to claim 7 wherein the engage member is a comb arrangement having a plurality of slots extending across the table transverse to the longitudinal direction of the sheet is arranged such that the blade engages the sheet material at the slots on the comb arrangement and wherein the comb arrangement is horizontally adjustable for exact slitting of the sheet material by the blade.

* * * * *